United States Patent [19]

Yoshikawa

[11] 3,978,831

[45] Sept. 7, 1976

[54] CONTROL DEVICE FOR A VACUUM ADVANCER

[75] Inventor: Eiji Yoshikawa, Susono, Japan

[73] Assignee: Toyota Jidosha Kogyo Kabushiki Kaisha, Toyota, Japan

[22] Filed: Nov. 7, 1973

[21] Appl. No.: 413,620

[30] Foreign Application Priority Data

July 3, 1973 Japan ..... 48-78521[U]

[52] U.S. Cl. ..... 123/117 A; 123/117 R; 123/146.5 A

[51] Int. Cl.[2] ..... F02P 5/08; F02P 5/10

[58] Field of Search..... 123/117 A, 117 R, 146.5 A

[56] References Cited

UNITED STATES PATENTS

| | | | |
|---|---|---|---|
| 3,234,929 | 2/1966 | Sarg | 123/146.5 A |
| 3,599,614 | 8/1971 | Kittredge | 123/117 A |
| 3,638,627 | 2/1972 | Beard | 123/117 A |
| 3,650,253 | 3/1972 | Cooksey | 123/117 A |
| 3,687,120 | 8/1972 | Lenz | 123/146.5 A X |
| 3,707,954 | 1/1973 | Nakada et al. | 123/117 A |
| 3,718,126 | 2/1973 | Oishi et al. | 123/117 A X |
| 3,793,833 | 2/1974 | van Basshuysen | 123/117 A X |
| 3,797,512 | 3/1974 | Martin | 123/117 A X |

*Primary Examiner*—Charles J. Myhre
*Assistant Examiner*—Tony M. Argenbright
*Attorney, Agent, or Firm*—Stewart and Kolasch, Ltd.

[57] ABSTRACT

A control device for a vacuum advancer of the type for actuating the vacuum advancer in the directions of advancing and delaying the ignition timing under the control of a discriminating means to evaluate the operating condition of the engine. The vacuum advancer is adapted to be selectively driven in either of said two directions by the difference between a fraction of the vacuum in the inlet tube of the carbureter or the inlet manifold and either the total vacuum in the inlet tube or manifold or the atmospheric pressure by employing only one switch-over valve.

5 Claims, 3 Drawing Figures

FIG. 1
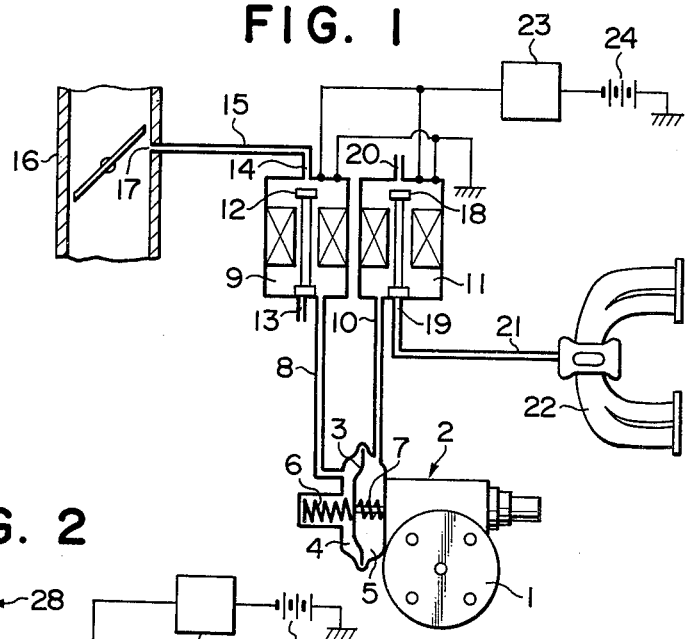
FIG. 2
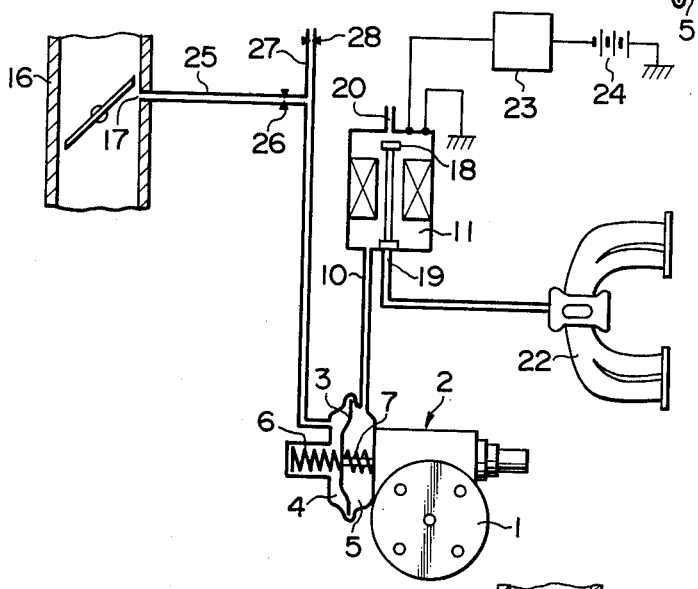
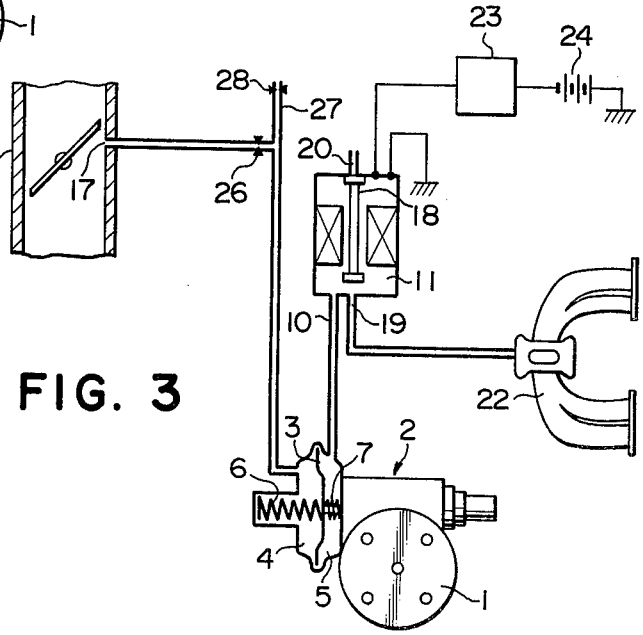
FIG. 3

CONTROL DEVICE FOR A VACUUM ADVANCER

BACKGROUND OF THE INVENTION

1. Field of the Invention

This invention relates to a vacuum advancer which controls the ignition timing of an internal combustion engine of the spark ignition type, and more particularly, to improvement of a control device for a vacuum advancer.

2. Description of the Prior Art

There has been proposed a vacuum advancer adapted to be operated in response to the operational conditions of an internal combustion engine of the spark ignition type so as to delay the ignition timing within such an extent as allowed according to the operational conditions of the engine thereby reducing the emission of harmful compositions in the exhaust gases, such as nitric oxide, hydrocarbons, etc. As a control device for controlling such a vacuum advancer in response to the operational conditions of the engine, there is conventionally known a device such as shown in FIG. 1.

In FIG. 1, 1 designates a distributor, and 2 is a vacuum advancer mounted to the distributor to advance or delay the ignition timing determined by the distributor. The vacuum advancer 2 includes, as the operational elements thereof, a diaphragm 3, diaphragm chambers 4 and 5 disposed for opposite sides of the diaphragm and adjusting springs 6 and 7 for adjusting displacement of the diaphragm in response to the pressure difference acting on opposite sides of the diaphragm. Thus, the vacuum advancer is adapted to advance or delay the ignition timing according to the displacement of the diaphragm. The diaphragm chamber 4 is connected to a solenoid valve 9 by way of a conduit 8 and the diaphragm chamber 5 is connected to a solenoid valve 11 by way of a conduit 10. The solenoid valve 9 has first and second ports 13 and 14 the opening and closing of which are controlled by a core 12, wherein the port 13 is opened to the atmosphere, and the port 14 is connected by way of a conduit 15 to an inlet tube 16 of the carburetor (not shown). The conduit 15 opens to the inside of the tube 16 at a port 17. The solenoid valve 11 also has first and second ports 19 and 20 the opening and closing of which are controlled by a core 18, wherein the port 19 is connected by way of a conduit 21 to an inlet manifold 22, while the port 20 is opened to the atmosphere. The solenoid valves 9 and 11 are supplied with electric power from an electric power source 24 controlled by a computer 23 adapted to evaluate the operating conditions of the engine based upon the automobile speed, loading condition, temperature of the cooling water of the engine, etc. said computer determining whether or not the engine is in a condition to allow delaying of the ignition timing. In operation, when the solenoid valve 9, is not energized, the core 12 is in its lowered position as shown in the drawing to close the port 13 and to open the port 14, thereby introducing the vacuum in the inlet tube 16 of the carbureter into the diaphragm chamber 4. When the solenoid valve 9 is energized, the core 12 is raised to open the port 13 and to close the port 14, thereby to introducing atmospheric pressure into the diaphragm chamber 4. As for the solenoid valve 11, when it is not energized, the core 18 is in its lowered position as shown in the drawing to close the port 19 and to open the port 20, thereby introducing the atmospheric pressure into the diaphragm chamber 5. When the solenoid valve is energized, the core 18 is raised to open the port 19 and to close the port 20, thereby introducing the vacuum in the inlet manifold 22 into the diaphragm chamber 5.

In the abovementioned device, when the computer 23 determines that the ignition timing is not to be delayed, that is, under the conditions when the temperature of the cooling water of the engine is low, the automobile is running at a high speed, etc., the solenoid valves 9 and 11 are not energized, thereby maintaining the core 12 and 18 at lowered positions as shown in FIG. 1, whereby the diaphragm chamber 4 is exposed to the vacuum in the inlet tube 16 of the carbureter, while the diaphragm chamber 5 is exposed to the atmospheric pressure. In this condition, the diaphragm 3 is biased leftward as shown in FIG. 1 by a pressure difference applied at opposite sides thereof while compressing the adjusting spring 6, whereby a normal vacuum advancing action of advancing the ignition timing is performed. On the contrary, when computer 23 has determined that the ignition timing may be delayed as in a normal running condition, etc., the solenoid valves 9 and 11 are energized to move the cores 12 and 18 upward as seen in FIG. 1 thereby opening the ports 13 and 19 and closing the ports 14 and 20, respectively, whereby the atmospheric pressure is introduced into the diaphragm chamber 4, while the vacuum in the inlet manifold 22 is introduced into the diaphragm chamber 5. Thus, the diaphragm 3 is biased rightward as seen in FIG. 1 by a reversed pressure difference thereby compressing the adjusting spring 7 to delay the ignition timing.

Such a conventional control device of the vacuum advancer requires two solenoid valves, whereby it becomes expensive, requires a large space for mounting, and possesses the drawback that the chance of a malfunction is more frequent as the number of parts incorporated in the device are increased.

SUMMARY OF THE INVENTION

Therefore, it is the object of this invention to improve the conventional control device for the vacuum advancer and to provide a novel control device for a vacuum advancer which employs only one solenoid valve that is equivalent to that of the conventional device employing two solenoid valves.

The above mentioned object is accomplished, according to this invention, by a control device for a vacuum advancer of an internal combustion engine, said vacuum advancer including two diaphragm chambers defined at opposite sides of a diaphragm and adapted to advance the ignition timing of said engine when said diaphragm is biased in one direction and to delay said ignition timing when said diaphragm is biased in the other direction, said device comprising switch-over means for selectively introducing either the vacuum in the inlet tube or manifold or atmospheric pressure into one of said diaphragm chambers, and a fraction generating means for generating a fraction of the vacuum in said inlet tube or manifold, said fraction being constantly introduced into the other of said diaphragm chambers.

In the control device as mentioned above according to this invention, one of the diaphragm chambers is constantly applied with a fraction of the vacuum in the inlet tube of the carburetor or the manifold without requiring valve means. On the contrary, by the use of a valve means the other diaphragm chamber is selectively applied with either atmospheric pressure which is higher than the fraction or with the total vacuum in the inlet tube or a manifold which is lower than the fraction, whereby the diaphragm is biased either to the advancing side or the delaying side to effect the advancing or delaying operation of the distributor. Thus, the control device according to this invention has a simple structure incorporating only one switch-over valve while obtaining a controlling operation substantially equivalent to that afforded by the conventional control device including two switch-over valves.

The single switch-over valve incorporated in the device according to this invention may also be a solenoid valve controlled by a computer adapted to evaluate the operating conditions of the engine.

According to another particular feature of this invention, said fraction of the vacuum in the inlet tube or manifold to be applied to one of said diaphragm chambers is produced by constricting a portion of a passage communicating with said one diaphragm chamber to the inside of the inlet tube or manifold and opening said passage to the atmosphere by way of a constricting means at a portion thereof located upstream of the constricted portion as seen along the flow of air through said passage.

The abovementioned fraction may preferably be adjusted to be substantially half of the vacuum in the inlet tube or manifold so that the displacement of the diaphragm to the advancing and delaying sides is effected under a force substantially of a same strength but opposite in the direction so that a substantially symmetrical structure can be employed for the diaphragm means.

BRIEF DESCRIPTION OF THE DRAWING

In the accompanying drawing,

FIG. 1 is a schematical view showing an example of the structure of the conventional control device for a vacuum advancer; and FIGS. 2 and 3 are schematical views showing an embodiment of the control device for a vacuum advancer according to this invention, wherein the showing is made by following that of FIG. 1.

DESCRIPTION OF THE PREFERRED EMBODIMENT

In the following, this invention is described in more detail with respect to the embodiments and with particular reference to FIGS. 2 and 3 which show an embodiment of the control device for a vacuum advancer according to the present invention following the manner shown in FIG. 1. FIG. 2 shows the control device in the operating condition of advancing the ignition timing and FIG. 3 shows the control device in the operating condition of delaying the ignition timing.

In FIGS. 2 and 3, the portions corresponding to those shown in FIG. 1 are designated by the same reference numerals.

In the device shown in FIG. 2 and 3, there is provided only one solenoid valve 11 corresponding to the solenoid valve 11 incorporated in the device shown in FIG. 1. The solenoid valve 11 in the device shown in FIGS. 2 and 3 is also adapted to be supplied with electric power from the electric power source 24 only when the delaying is to be effected according to the discriminating function made by the computer 23 as to whether or not the delaying of the ignition timing is to be effected.

The diaphragm chamber 4 is directly connected by way of a conduit 25 to the inlet tube 16 of the carburetor, not shown to be opened to the inside of the tube at the port 17. The conduit 25 is provided with a constricting means 26 such as a constricting orifice means disposed therein as well as a branch pipe 27 connected thereto at a portion located upstream of the constricting means 26 as seen from the port 17. The free end of the branch pipe 27 is opened to the atmosphere by way of a constricting means 28. In this device, when the computer 23 has determined that the ignition timing should not be delayed as in operating conditions wherein the temperature of the engine is low, the automobile is running at a high speed, etc., the solenoid valve 11 is not energized, thus maintaining the core 18 thereof at its lowered position, as shown in FIG. 2, thereby closing the port 19 communicating with the inlet manifold 22 and opening the port 20 to the atmosphere. In this condition, the diaphragm chamber 5 is applied with the atmospheric pressure introduced therein, while the vacuum in the inlet tube 16 of the carburetor reaches the diaphragm chamber 4 through the conduit 25. In this case, however, as a vacuum is formed at the inside of the conduit 25, air flows into the conduit 25 through the constricting means 28 and the branch pipe 27, whereby the vacuum in the conduit 25 is attenuated and only a fraction of the vacuum in the inlet tube of the carburetor is applied to the diaphragm chamber 4. Therefore, in this case the pressure difference acting at the diaphragm 3 is not the total vacuum residing at the inside of the inlet tube of the carburetor but only a fraction thereof. In this case, it is only necessary that the adjusting spring 6 is made softer than that used in the device shown in FIG. 1 according to the amount of the fraction, whereby the diaphragm 3 can be displaced as much by the pressure difference corresponding to the fraction of the vacuum in the inlet tube of the carburetor as in the device shown in FIG. 1 wherein the total vacuum is applied to the diaphragm, thereby securing that the ignition time is advanced by any required amount.

When the computer 23 has determined that the engine is in the operating condition to allow the delaying of the ignition timing such as in a normal running condition, etc., the solenoid valve 11 is energized to raise the core 18 as shown in FIG. 3, whereby the port 19 communicating with the inlet manifold 22 is opened and the port 20 communicating with the atmosphere is closed. In this condition, the total vacuum residing at the inside of the inlet manifold 22 is introduced into the diaphragm chamber 5. The vacuum in the inlet manifold 22 is substantially equivalent to that of the inlet tube 16 of the carburetor. The diaphragm 3 is applied with a differential pressure corresponding to the difference between the total vacuum in the inlet manifold and the fraction of the vacuum in the inlet tube of the carburetor applied to the diaphragm chamber 4 under the functions of the constricting means 26, branch pipe 27 and constricting means 28, said differential pressure acting to urge the diaphragm 3 rightward as seen in FIG. 8. By the rightward displacement of the diaphragm 3, the vacuum advancer 2 is operated in the direction of delaying the ignition timing. In this connection, it is also required that the adjusting spring 7 is also made softer than that included in the device shown in FIG. 1 so that the diaphragm 3 can be biased by the amount as required even under the application of a differential pressure which is not equivalent to the total vacuum in the inlet manifold 22 as in the case of the device shown in FIG. 1 but the difference between the total vacuum and the fraction of the vacuum in the inlet tube of the carburetor.

The amount of the fraction of the vacuum in the inlet tube 16 of the carburetor to be applied to the diaphragm chamber 4 may preferably be designed to be about half of the total vacuum in consideration of the balance of the displacement of the diaphragm 3 required in opposite directions for advancing and delaying the ignition timing.

Although in the above described embodiment this invention is applied to an engine having a carbureter, it will be understood that this invention can also be applied to an internal combustion engine of the spark ignition type equipped with a fuel injection system. In this case, it is only necessary that the port 17 is provided to open to the inside of the inlet tube at a portion near to the throttle valve so as to take out the vacuum in the inlet tube.

It is to be noted that the device shown in FIGS. 2 and 3 is an embodiment of this invention constituted by following an example of the conventional control device for a vacuum advancer such as shown in FIG. 1 and that this invention is of course not limited to such an embodiment but can be practiced by any other concrete structure without departing from the scope of this invention as defined in the attached claims.

I claim:

1. In an internal combustion engine having an inlet tube and a vacuum advancer, said vacuum advancer including two diaphragm chambers defined at opposite sides of a diaphragm and adapted to advance the ignition timing of said engine when said diaphragm is biased in one direction and to delay said ignition timing when said diaphragm is biased in the other direction, the improvement comprising, a control device for said vacuum advancer, said control device comprising switch-over means for selectively introducing either the vacuum in the inlet tube or manifold or atmospheric pressure into one of said diaphragm chambers, and a fraction generating means for constantly generating substantially a one-half fraction of the intake vacuum throughout substantially the entire intake vacuum level, said fraction being constantly introduced into said other of said diaphragm chambers.

2. A control device according to claim 1, wherein said switch-over means is a single switch-over valve.

3. A control device according to claim 2, wherein said valve is a solenoid valve and a computer is operatively associated with said valve, said computer being adapted to evaluate the operating conditions of said engine.

4. A control device according to claim 1, wherein said fraction generating means comprises means for constricting at a constant rate a portion of a passage communicating said one diaphragm chamber to the inside of said inlet tube or manifold and means for opening said passage to the atmosphere by way of a second constantly rated constricting means at a second portion thereof located upstream of the first-mentioned constricting means as seen along the flow of air through said passage.

5. A control device according to claim 1, wherein said switch-over means is a single solenoid valve operatively associated with a computer and adapted to evaluate the operating conditions of said engine, and said fraction generating means comprising means for constricting at a constant rate a portion of a passage communicating said one diaphragm chamber to the inside of said inlet tube or manifold and means for opening said passage to the atmosphere by way of a second constantly rate constricting means at a second portion thereof located upstream of the first-mentioned constricting means as seen along the flow of air through said passage.

* * * * *